United States Patent [19]

Stoner

[11] Patent Number: 4,865,558

[45] Date of Patent: Sep. 12, 1989

[54] STABILIZING BUSHING FOR ELECTRICAL CONNECTOR

[75] Inventor: Daryl L. Stoner, Rexmont, Pa.

[73] Assignee: AMP Incorporated, Harrisburg, Pa.

[21] Appl. No.: 276,184

[22] Filed: Nov. 23, 1988

[51] Int. Cl.[4] ..... H01R 13/52; H01R 13/629

[52] U.S. Cl. ..... 439/246; 439/271

[58] Field of Search ..... 439/271–277, 439/549, 246, 252

[56] References Cited

U.S. PATENT DOCUMENTS

| | | | |
|---|---|---|---|
| 4,193,655 | 3/1980 | Herrmann, Jr. | 439/271 |
| 4,214,802 | 7/1980 | Otani et al. | 439/275 |
| 4,621,883 | 11/1986 | Noguchi | 439/271 |
| 4,648,672 | 3/1987 | Kobler | 439/271 |
| 4,690,478 | 9/1987 | Rahrig et al. | 439/271 |
| 4,701,004 | 10/1987 | Yohn | 439/871 |
| 4,713,021 | 12/1987 | Kobler | 439/272 |
| 4,741,590 | 5/1988 | Caron | 350/96.21 |
| 4,787,864 | 11/1988 | Hunt, III et al. | 439/595 |

OTHER PUBLICATIONS

Great Britain Patent Application, Ser. No. 8817402.4, Jul. 21, 1988.

*Primary Examiner*—Gary F. Paumen

*Attorney, Agent, or Firm*—Anton P. Ness

[57] ABSTRACT

A bushing is placed around a smaller diameter conductor wire rearwardly of an electrical terminal terminated to a conductor end, and is placed within and along a large diameter rearward passageway portion of a connector housing passageway in which the terminal is disposed and removably retained, with the bushing having an outer diameter corresponding to that of the passageway portion. The bushing prevents the rearward end of the terminal from being urged off-center when the conductor is bent at a right angle to extend along the wire exit face of the housing, thus maintaining the conductor concentrically along the entire length of the rearward passageway portion when it otherwise would assume an angle therealong and also urge the rearward terminal end off-center; the bushing thus maintains alignment of the terminal axially along the passageway to minimize potential stubbing during mating of the terminal with a mating terminal. The bushing is adapted to permit slight adjustment movement of the rearward terminal end to allow the terminal to align itself with the mating terminal during connector mating.

8 Claims, 3 Drawing Sheets

STABILIZING BUSHING FOR ELECTRICAL CONNECTOR

FIELD OF THE INVENTION

The present invention relates to the field of electrical connectors and more particularly to axial alignment of terminals along housing passageways upon insertion thereinto after being terminated to electrical conductor wires.

BACKGROUND OF THE INVENTION

Certain electrical connectors are known in which electrical terminals are terminated onto conductor wires and then inserted into terminal-receiving passageways of a connector housing from rearwardly thereof, remote from a manufacturing site and specialized tools and apparatus; the connector housing is of the type having passageways made to receive and retain therein a terminal having a selected diameter, in a manner which permits removal and replacement of each terminal if desired The terminals are secured along the housing passageways at a retention area located just rearwardly of the forward contact section of the terminal, and the retention area consists of forward and rearward stops axially spaced closely together. Certain ones of the terminals of that diameter are coaxial-type terminals, each one having an inner contact and an outer contact, and being terminatable onto an end of a coaxial cable, with the outer contact connected to the shielding braid of the coaxial cable; the terminals are substantially larger in diameter than the coaxial cables; and the terminal-receiving passageways for the terminals are therefore larger in diameter than the coaxial cables.

In such an arrangement one consequence is that the rearward portion of the passageway is substantially larger than the diameter of the cable, which extends therealong rearwardly of the terminal rearward end, and when the cable commonly is deflected to one side along the wire exit face of the housing prior to mating of the connector with a mating connector, the cable portion within the rearward passageway portion assumes a relatively severe angle with respect to the passageway axis until it encounters the side wall of the passageway along the wire exit face; the deflected cable pulls to the side the rearward end of the terminal to which it is affixed, resulting in the terminal assuming an angle with respect to the passageway axis. While female terminals resist being angled because the forward end of the receptacle contact section of each terminal in the respective forward passageway portion engages the passageway side walls, the male contact sections extend forwardly from the passageways in order to be able to enter the corresponding female contact sections, and thus are not angularly stabilized by structure of the housing when torque is applied by the respective cable. With one of the male contact sections being disposed at a severe angle from axial, the male contact commonly stubs against the mating connector housing or the forward end of the corresponding female contact, preventing connector mating and possibly damaging the contacts or the connectors, or permitting connector mating but forcing the stubbing terminal rearwardly along the housing passageway in a non-mated condition which may remain undetected. Female terminals may also be susceptible to severe axial misalignment because of bent cables if the forward housing passageway is axially short and does not sufficiently inhibit angling of the female terminal, or if the female terminals extend substantially forwardly of the housing mating face.

It is desired to provide assurance of axial alignment of the terminals disposed in housing passageways which are much larger in diameter than the cables to which the terminals are terminated.

SUMMARY OF THE INVENTION

The present invention comprises a bushing having a bore therethrough and placed around the cable rearwardly of the terminal terminated to the cable, having an outer diameter selected to just fit within the rearward passageway portion when the terminal is secured within the passageway forwardly thereof; the bushing may also be elastomeric and be slightly larger than the rearward passageway portion resulting in an interference fit. The bushing has a length selected to just fit along the rearward passageway portion. By extending to the wire exit face of the housing, the bushing results in keeping the entire length of cable portion centered within the rearward housing passageway and moving the bend point of the cable to the wire exit face and relieves the terminal from being forced into an angle by the cable. Preferably the bushing has a profiled bore therethrough larger in diameter at the forward end to receive a rearward end of the terminal therewithin and be radially slightly spaced therearound; the bushing thereby permits the terminal to retain its ability to align itself during mating with the mating terminal by being free to be moved incrementally angularly and laterally, by not locking the rearward terminal end into a tightly fixed position. The bushing may be slit axially therealong radially to the center to be placed onto the cable after the terminal has been terminated thereonto, and even after the terminated terminal has been secured within the housing. Use of the bushing still permits removal and replacement of the terminal, if desired.

It is an objective of the invention to provide a simple economical method for maintaining the axial alignment of terminals when the smaller diameter conductor wire to which it is terminated is bent at a severe angle and the rearward housing passageway provides no structure protecting the terminal from becoming axially misaligned by the bent conductor, while still enabling removal and replacement of the terminal.

An embodiment of the present invention will now be described, with reference to the accompanying drawings.

DETAILED DESCRIPTION OF THE PREFERRED EMBODIMENT

Figure 1:
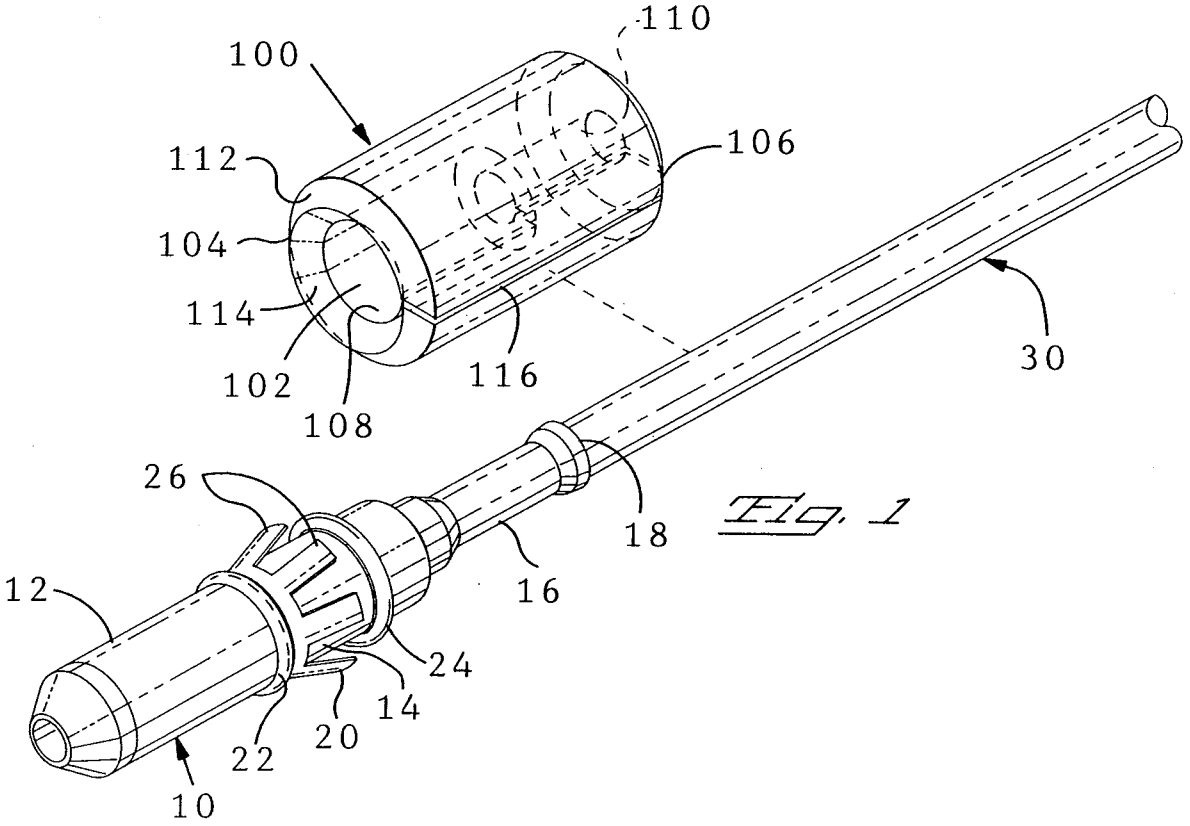
FIG. 1 is a perspective view of a plug terminal terminated to a conductor wire and a bushing of the present invention exploded therefrom.

FIG. 1 illustrates a terminal 10 terminated onto an end of a conductor 30, and in the disclosed embodiment includes a male or plug contact portion 12 at its forward end, a retention section 14, and a barrel-shaped conductor termination section 16 rearwardly therefrom concluding in rearward end 18. A retention clip 20 is shown disposed around retention section 14 between a forward ridge 22 and a rearward ridge 24, and includes a plurality of lances 26 extending rearwardly and outwardly. The stabilizing bushing of the present invention is useful with female terminals as well; and while the disclosed embodiment involves a coaxial terminal, the present invention is also useful with power and signal terminals as well, such as conventional pin and socket terminals.

A bushing 100 of the present invention is shown exploded from terminated conductor 30 to be disposed therearound at the rearward end of terminal 10. Bushing 100 includes a profiled bore 102 extending from a forward end 104 to a rearward end 106, and bore 102 includes a forward portion 108 and a rearward portion 110, with the diameter of rearward portion 110 being just large enough to fit around conductor 30 in preferably a gripping engagement. The diameter of forward portion 108 is large and is preferably larger than the outer diameter of the termination section 16 of terminal 10. Forward end 104 preferably includes a chamfered outer edge 112 and a chamfered inner edge 114 to facilitate insertion over termination section 16 and eventual insertion into a housing passageway. Bushing 100 may be made of elastomeric material and is shown having a slit 116 therealong extending radially inwardly to intersect profiled bore 102; slit 116 enables bushing 100 to be placed around a conductor 30 after terminal 10 has been terminated to the conductor. Otherwise a bushing is placed around conductor 30 prior to terminal 10 being terminated thereto.

Figure 2:
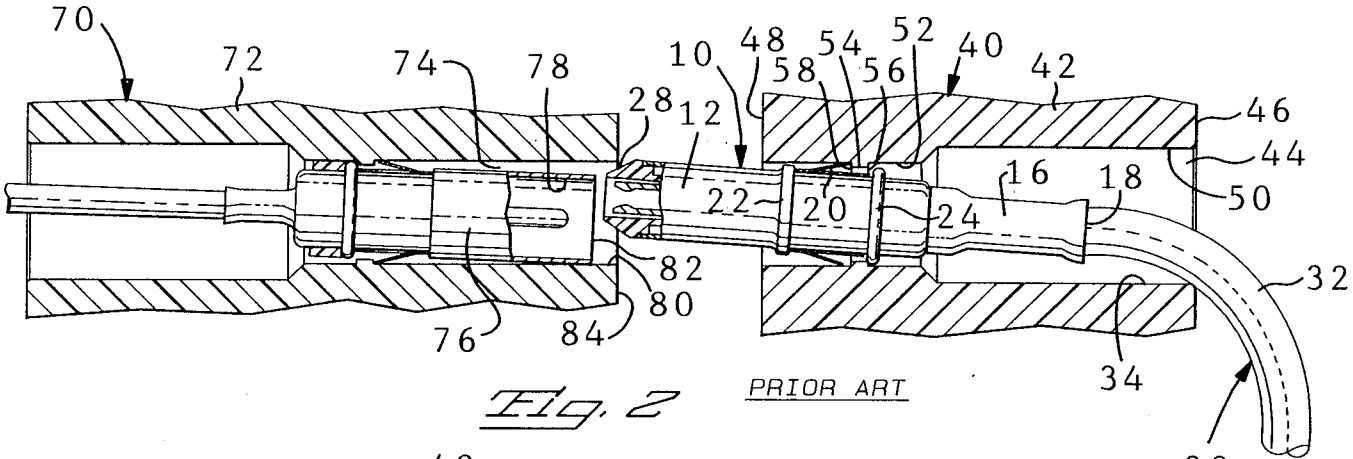
PRIOR ART FIG. 2
FIG. 2 is a longitudinal section view of housed plug and receptacle terminals in mating connectors illustrating a misaligned plug terminal as in the prior art.

The problem met by bushing 100 of the present invention is illustrated in FIG. 2. Connector 40 includes a housing 42 having one or more passageways 44 within which respective terminals 10 terminated to respective cables 30 are disposed, where connector 40 is adapted to receive the terminals as terminated to cables 30 insertably thereinto from a wire exit face 46 toward a mating face 48 and to retain the terminals therein in a manner permitting removal and replacement. Mating connector 70 includes a housing 72, passageways 74 within which respective terminals 76 are retained. Terminals 76 are receptacle terminals matable with plug terminals 10, and have receptacle contact portions 78 disposed entirely within forward passageway portions 80; forward ends 82 are slightly recessed rearwardly from mating face 84. Plug contact portions 12 of terminals 10 extend forwardly of mating face 48 to enter forward passageway portions 80 and into receptacle contact portions 78 of terminals 76. Terminals 10 and 76 as shown are of a known type for terminating coaxial cables and include inner and outer contacts where the inner contact is for signal transmission and the outer contact is for ground and shielding and is terminated to a braid of the coaxial cable.

Each passageway 44 of housing 42 includes a rearward portion 50 of large diameter to initially receive a terminal 10 during insertion from wire exit face 46, and a retention section 52 of smaller diameter including a stop shoulder 54 having a rearwardly facing stop surface 56 and a forwardly facing stop surface 58. Rearward terminal ridge 24 is larger in diameter than passageway stop shoulder 54 to engage therebehind to stop forward axial movement along passageway 44 when fully inserted. Forward ridge 22 comprises a forward stop against which a forward end of retention clip 20 abuts. Retention clip lances 26 after terminal insertion engage against forwardly facing surface 58 of passageway stop shoulder 54 to resist rearward axial movement of terminal 10 after insertion. Receptacle terminal 76 is similarly retained in passageway 74 of housing 72. The retention system for terminals 10,76 allows incremental movement of each terminal within its respective passageway, and with a forward end 28 being chamfered peripherally therearound to provide lead-in benefits, plug terminal 10 is capable of being urged laterally to enter forward passageway portion 80 if already approximately aligned therewith, and then to enter receptacle contact portion 78.

FIG. 2 shows plug terminal 10 at a severe angle with respect to the axis of passageway 44, and the chamfered forward end 28 commonly stubs when at such a severe angle, not entering receptacle contact portion 78 and thus not mating, or possibly not entering forward passageway portion 80. The plug terminal 10 is at such an angle because cable 30 is bent at a right angle at region 32 to extend along wire exit face 46 of housing 42, engaging the side wall 34 of rearward passageway portion 50 at the wire exit face 46 and urging rearward end 18 partially toward passageway side wall 34 midway along rearward passageway portion 50 and away from the central axis of passageway 44. This action causes the forward end 28 of terminal 10 to be deflected away from the passageway axis in the opposite direction, with engagement of the terminal 10 and its retention clip 20 with the passageway retention portion 52 acting as a pivot. While receptacle terminal 76 also may be angled out of alignment in a similar manner by its cable, the angle is much less due to the forward terminal end 82 engaging the passageway side wall 80 far forwardly of the retention area, and an aligned plug terminal could easily mate with such an angled receptacle terminal.

Figure 3:
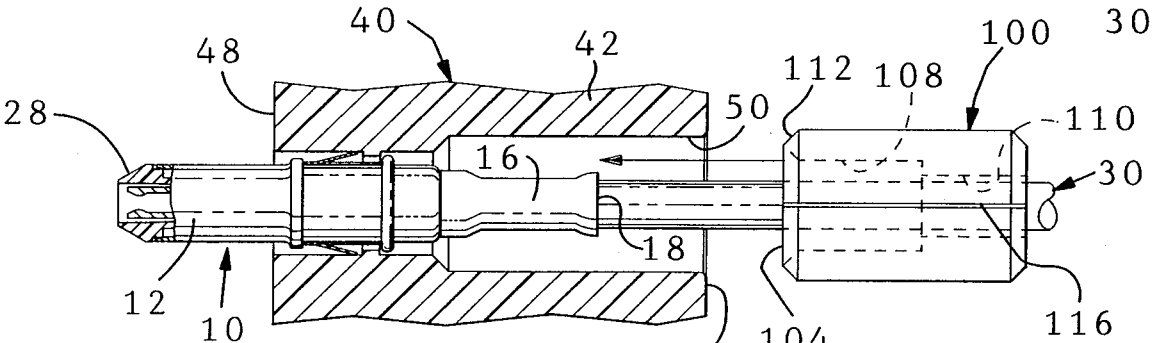
FIG. 3 is a longitudinal section view of the bushing of FIG. 1 being assembled to a terminated conductor disposed within a housing passageway.
Figure 4:
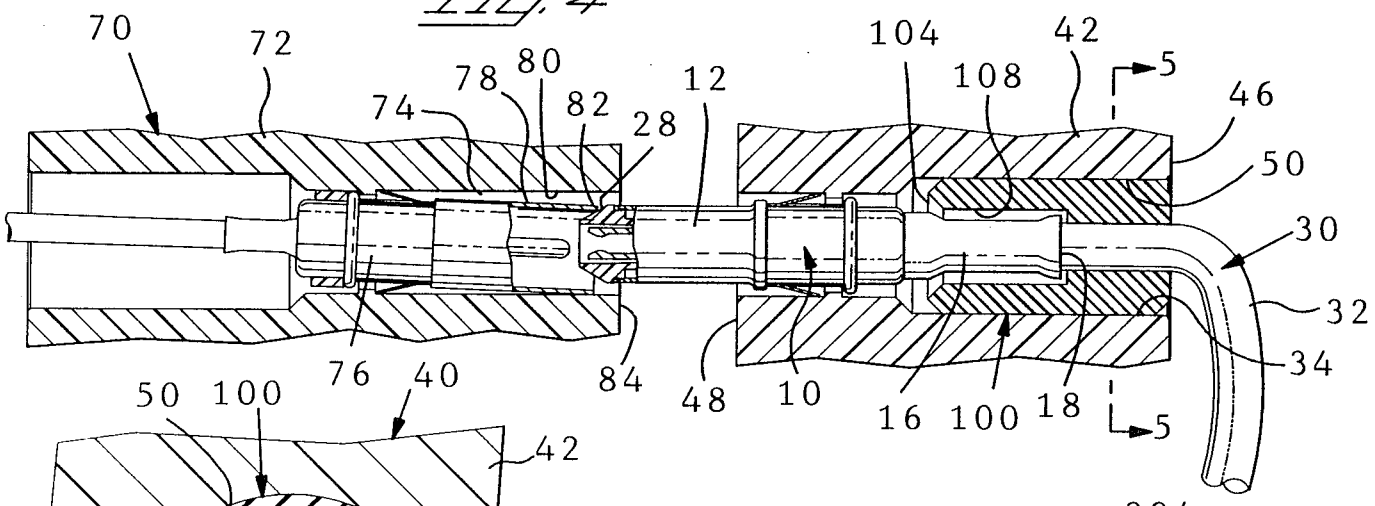
FIG. 4 is a view similar to FIG. 2 with a bushing of the present invention in place in the passageway.
Figure 5:
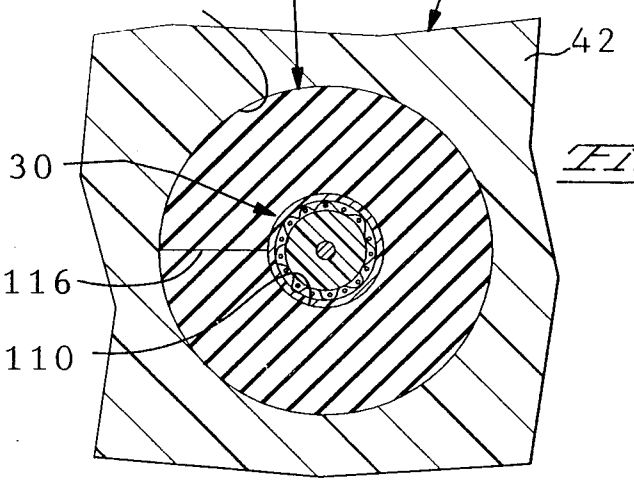
FIG. 5 is a cross-sectional view taken along lines 5—5 of FIG. 4.

In FIG. 3 a bushing 100 of the present invention is being assembled to a cable 30 having a plug terminal 10 terminated thereon and already mounted within passageway 44 of housing 42. Bushing 100 is secured around cable 30 and is being inserted into rearward passageway portion 50 behind terminal 10. In FIG. 4, bushing 100 has been located in place within rearward passageway portion 50, around cable 30 and also around termination section 16 of plug terminal 10. Bushing 100 may be elastomeric and have an outer diameter slightly larger than that of rearward passageway portion 50 to establish an interference fit therewithin. Bushing 100 could also include a plurality of annular ribs therealong (not shown) having the larger diameter, or a plurality of bosses therealong and therearound defining an effective outer diameter such as in FIG. 6, and which establish the interference fit. FIG. 5 illustrates a cross-section of the bushing 100 about cable 30 within rearward passageway portion 50.

In FIG. 4 cable 30 is again bent to a right angle along wire exit face 46 of housing 42. Because of the presence of bushing 100 around cable 30 within rearward passageway portion 50, all of cable 30 within the housing remains centered along the passageway axis, thus not forcing terminal 10 to assume an angle with respect to the axis. Terminal 10 remains axially aligned, and chamfered forward end 28 enables plug contact portion 12 to enter forward portion 80 of corresponding passageway 74 and matingly engage receptacle contact portion 78 of receptacle terminal 76, even if terminal 76 is slightly out of alignment. Because terminal 76 may commonly be at a slight angle with its forward end 82 off center, plug terminal 10 must be able to move incrementally in response to chamfered forward end 28 engaging structure during mating. Forward bushing bore portion 108 allows incremental adjustment movement of terminal 10 by allowing termination portion 16 to move slightly to the side in a pivotal manner caused by the retention system when plug contact portion 12 is urged to the opposite side by the mating terminal's contact section.

Figure 6:
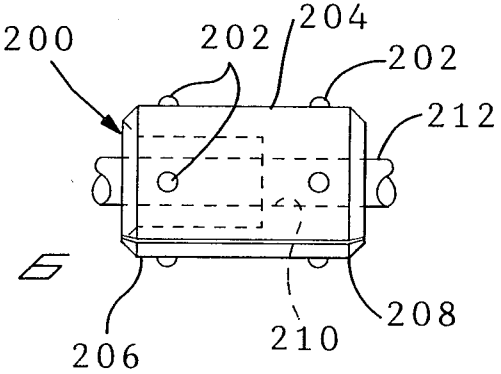
FIG. 6 is an alternate embodiment of bushing.

An alternate embodiment of bushing 200 is shown in FIG. 6. A plurality of small rounded bosses 202 is formed along and around the outer surface 204 of bushing 200 at least at forward and rearward ends 206,208 thereof, bosses 202 being able to compensate for slight manufacturing tolerances in the bushing outside diameter and in the inside diameter of the rearward passageway portion into which the bushing will eventually be disposed, to assure an interference fit even if diameter tolerances are unfavorable. Bosses 202 should be disposed spaced angularly therearound such as at 90° locations. The inside diameter of rearward bore portion 210 may also be slightly less than the diameter of cable 212 to assure a gripping of bushing 200 with cable 212 both before and after complete connector assembly.

The stabilizing bushing may be used with receptacle terminals as well as plug terminals, and with pin and socket terminals for example, and is useful with electrical conductors other than coaxial cable disclosed in the embodiment discussed herein. Other variations and modifications may be made to the stabilizing system of the present invention while remaining within the spirit of the invention and the scope of the claims.

What is claimed is:

1. A system for stabilizing the alignment of a terminal terminated to a conductor wire and disposed within a passageway of a housing, wherein the passageway includes a rearward passageway portion having a diameter substantially larger than the diameter of the conductor extending therealong rearwardly from the terminal to exit the passageway at a wire exit face of the housing, wherein the conductor is susceptible to being bent to extend laterally along the wire exit face and urge the rearward end of the terminal rearward end toward a side wall of the rearward passageway portion, comprising:

a bushing having an outer diameter approximately equal to the diameter of said rearward passageway portion, said bushing having a profiled bore extending concentrically therethrough having a rearward bore portion approximately equal to the conductor diameter and adapted to receive said conductor therealong, said profiled bore further having a forward bore portion larger in diameter than the diameter of a rearward portion of the terminal extending into said rearward passageway portion, said bushing being adapted to be received along said conductor and into said rearward passageway portion from said wire exit face, whereby said bushing which is within said rearward passageway portion and about said conductor retains said conductor concentrically within said rearward passageway portion resulting in said rearward terminal end being protected from being urged off-center by said conductor being bent along said wire exit face, thereby maintaining said terminal substantially axially aligned along said passageway.

2. A system as set forth in claim 1 wherein said bushing includes a slit therealong extending radially inwardly to intersect said profiled bore, permitting installation onto a conductor after a terminal has been terminated to the end of the conductor.

3. A system as set forth in claim 1 wherein said bushing includes a chamfered forward end outer edge facilitating insertion into said rearward passageway portion from said wire exit face.

4. A system as set forth in claim 1 wherein said bushing includes a chamfered forward end inner edge facilitating receipt of said rearward terminal end thereinto during assembly.

5. A system as set forth in claim 1 wherein said bushing outer diameter is slightly larger than the diameter of said rearward passageway portion, and said bushing is made of compressible material, whereby said bushing establishes an interference fit within said rearward passageway portion after insertion thereinto.

6. A system as set forth in claim 1 wherein said rearward bore portion has a diameter just larger than the diameter of said conductor, thereby facilitating said bushing being moved along said conductor prior to insertion into said rearward passageway portion.

7. A system as set forth in claim 1 wherein said rearward bore portion has a diameter just smaller than the diameter of said conductor facilitating gripping to said conductor prior to insertion into said rearward passageway portion.

8. A system as set forth in claim 1 wherein said bushing includes a plurality of bosses extending outwardly from an outside bushing surface at least proximate forward and rearward ends of said bushing to facilitate an interference fit of said bushing within said rearward passageway portion.

* * * * *

UNITED STATES PATENT OFFICE

CERTIFICATE OF CORRECTION

Patent No. 4,865,558 Dated September 12, 1989

Inventor(s) Daryl L. Stoner

It is certified that error appears in the above-identified patent and that said Letters Patent is hereby corrected as shown below:

In column 5, line 48, claim 1, delete the second occurrence of "rearward end".

Signed and Sealed this

Seventeenth Day of July, 1990

*Attest:*

HARRY F. MANBECK, JR.

*Attesting Officer*

*Commissioner of Patents and Trademarks*